US005398873A

United States Patent [19]

Johnson et al.

[11] Patent Number: 5,398,873

[45] Date of Patent: Mar. 21, 1995

[54] FLUID PULSATOR WITH ACCUMULATOR FOR FREQUENCY CONTROL

[76] Inventors: Lonnie G. Johnson, 4030 Ridgehurst Dr., Smyrna, Ga. 30080; John T. Applewhite, 138 Belmonte Dr., SW., Atlanta, Ga. 30311

[21] Appl. No.: 234,405

[22] Filed: Apr. 28, 1994

[51] Int. Cl.[6] ..... B05B 1/08

[52] U.S. Cl. ..... 239/99; 239/381; 239/526

[58] Field of Search ..... 239/99, 101, 102.1, 239/380, 381, 435, 526

[56] References Cited

U.S. PATENT DOCUMENTS

| | | | |
|---|---|---|---|
| 3,521,819 | 7/1970 | Johnston | 239/99 |
| 4,177,926 | 12/1979 | Hunter | 239/99 |
| 4,270,697 | 6/1981 | Georgiev et al. | 239/99 |

*Primary Examiner*—Willliam Grant
*Attorney, Agent, or Firm*—Michael Drew

[57] ABSTRACT

A fluid pulsator (10) has a main housing (20) having an outlet conduit (24) projecting into a chamber (25) defined by the front of the main housing (20). A primary piston (30) is reciprocally translatable within the main housing (20) and has fluid conduits (34) for fluid flow through its body. A plunger (40) is spring-loaded and reciprocally translatable through the primary piston (30). The head (42) of the plunger abuts the front end of the primary piston (30) when the plunger (40) is in its retracted position. The main housing (20) has an abutment in the form of a flange (26) that defines the rearwardmost position of the primary piston (30). The main housing (20) contains a mechanism (21) for engaging the end of the plunger (40) so as to maintain the plunger (40) in its forwardmost position until released. Fluid flows (11) generally from the posterior portion of the main housing (20) through the primary piston (30) toward the anterior end. Attached to the main housing (20) is an accumulator (50) having an accumulator housing (52) and a mechanism (54, 55, 56, 58) for reciprocally varying the fillable volume of the accumulator housing (52) and biasing the fillable volume in a position of least fillable volume.

10 Claims, 3 Drawing Sheets

FLUID PULSATOR WITH ACCUMULATOR FOR FREQUENCY CONTROL

TECHNICAL FIELD OF THE INVENTION

The present invention relates to a device for projecting an intermittent stream of fluid.

BACKGROUND OF THE INVENTION

Devices for projecting a stream of fluid, particularly water and similar liquids, are used in many ways. A stream of water is often used in cleaning applications such as the use of a water hose directing a stream of water to wash a vehicle, or the projection of a stream of water to help clean teeth. A steady stream of a fluid such as water may be inadequate when used in cleaning because a steady stream of fluid directed to a single area creates a boundary layer which diminishes the fluid force impinging the area. Effective cleaning by a stream of water or other fluid requires that the area be impinged with sufficient impinging force. A boundary layer is generally not created when a stream of fluid is projected intermittently. Thus, an intermittent flow of fluid is a more effective means of impingement cleaning of an area than use of a steady stream of fluid. A projected stream of water is also used in the entertainment context of water guns which project a stream of water. An intermittent flow of fluid is useful in water guns to provide a machine-gun like effect when projecting a stream of water that has been pressurized. Thus, it can be appreciated that it would be useful to have an effective means of projecting an intermittent stream of fluid.

SUMMARY OF THE INVENTION

It is an object of the invention to provide a means for projecting an intermittent stream of fluid.

It is also an object of the invention to provide a means for projecting an intermittent stream of fluid whose frequency is adjustable.

In the present invention, a main housing having an outlet conduit projecting into a chamber defined by the front of the main housing has a primary piston which is reciprocally translatable within the main housing. The primary piston has fluid conduits for fluid flow through its body. A plunger is spring-loaded and reciprocally translatable through the primary piston. The head of the plunger abuts the front end of the primary piston. The main housing provides an abutment that defines the rearwardmost position of the primary piston. The main housing contains a mechanism for engaging the end of the plunger so as to maintain the plunger in its forwardmost position until released. Fluid flows generally from the posterior portion of the main housing through the primary piston toward the anterior end. Attached to the main housing is an accumulator having an accumulator housing and having a mechanism for reciprocally varying the fillable volume of the accumulator housing and biasing the fillable volume in a position of least fillable volume.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 1:
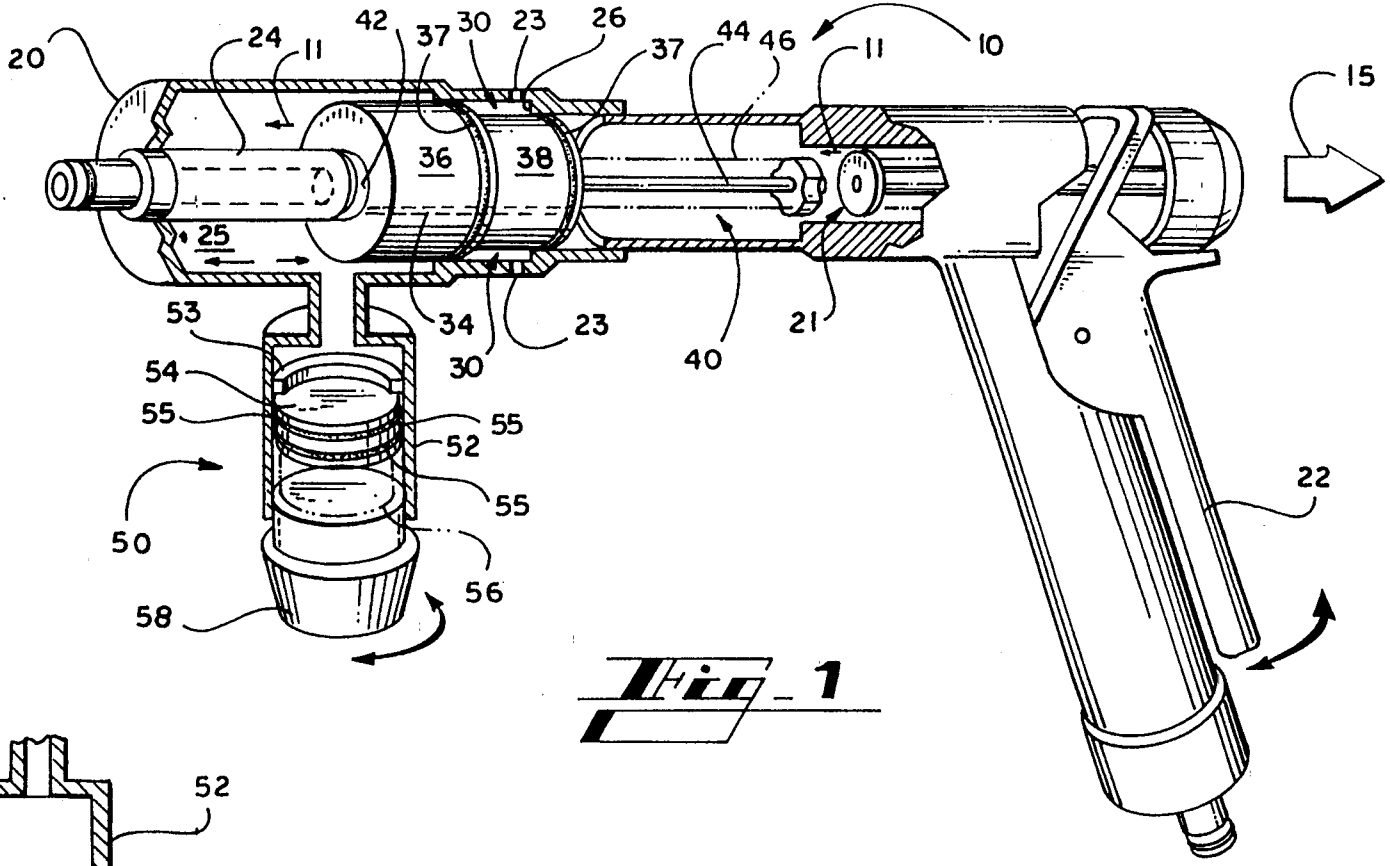
FIG. 1 is an isometric illustration of a fluid pulsator according to a preferred embodiment of the present invention.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to refer to identical features.

In general, the invention uses intermittent pressurization of fluid to intermittently project fluid. Referring first to FIG. 1, therein is shown in isometric illustration a fluid pulsator 10 according to a preferred embodiment of the invention. The fluid pulsator 10 illustrated and discussed herein is particularly suited for directing an intermittent stream of water. Fluid flow throughout the illustrations is illustrated by direction arrows denoted by the numeral 11. Movement of components of the pulsator 10 is illustrated by arrows denoted by the numeral 13. A main housing 20 generally forms a piston sleeve for a primary piston 30. A spring-loaded stop 21 for engaging a plunger 40, which will be described in greater detail below, and, a handle 22 for retracting the stop 21 are positioned at the rear of the main housing 20. The main housing 20 also contains a pair of apertures 23 for intake and venting, as will be described in greater detail below. An outlet conduit 24 leads to an outlet port at the front end of the main housing 20. The front portion of the main housing 20 generally defines a fluid chamber 25 from which fluid may exit the main housing 20. The main housing 20 is contoured to form a flange 26 as an abutment for engaging the forward portion 36 of the primary piston 30 when the primary piston moves rearward. The primary piston 30 has a main bore 32 through which the rod 44 of the plunger 40 is reciprocally translatable. The primary piston 30 also defines fluid conduits 34 running through its length for passage of the fluid 11 to be pressurized and projected from the chamber 25. In the preferred embodiment illustrated the fluid conduits 34 are generally axially positioned in close proximity to the centralized bore 32. Varying the size or number of conduits 34 extending through the primary piston 30 concomitantly varies the time for a given quantity of fluid to pass from the rear to the front of the primary piston 30. The primary piston 30 has a forward portion 36 of a greater diameter than the rearward portion 38. The forward portion 36 cooperates with the flange 26 to prevent rearward movement of the primary piston 30 beyond the point at which the flange 26 engages the beginning of the forward portion 36. O-rings 37 provide a seal for the primary piston 30 within the main housing 20. The plunger 40 generally consists of a piston head 42 and a piston rod 44 extending therefrom. The top 43 of the plunger head 42 is made of compressible material such as rubber or a closed-cell material having rubber-like compressibility to achieve a snug engagement between the piston head 42 and the opening to the outlet conduit 24. The plunger 40 is biased in a retracted position with respect to the primary piston 30 by the plunger spring 46. An accumulator 50 is attached to the front end of the main housing 20 at the chamber 25 portion. The accumulator generally consists of an accumulator housing 52 within which an accumulator piston 54 is reciprocally translatable. A flange 53 serves as a stop which sets the upwardmost position of the accumulator piston 54. O-rings 55 form a seal between the accumulator piston 54 and the accumulator housing 52. The fillable volume of the accumulator housing 52 is generally defined by the accumulator housing 52 and accumulator piston 54. An accumulator spring 56 is the biasing means which permits the fillable volume of the accumulator housing 52 to expand gradually to a point of unyielding resistance. The point of unyielding resistance sets the maximum fillable volume of the accumulator housing 52. The upwardmost position of the accumulator piston 54 sets the minimum fillable volume. A helical spring as shown is suitable in the preferred embodiment. The adjusting knob 58 is a threaded member which projects inwardly of the accumulator housing 52. Rotation of the adjusting knob 58 changes the maximum fillable volume of the accumulator housing 52 by adjusting the pre-compression of the accumulator spring 56. This serves to increase or decrease the frequency of the device 10 as will be described in greater detail below.

Figure 2:
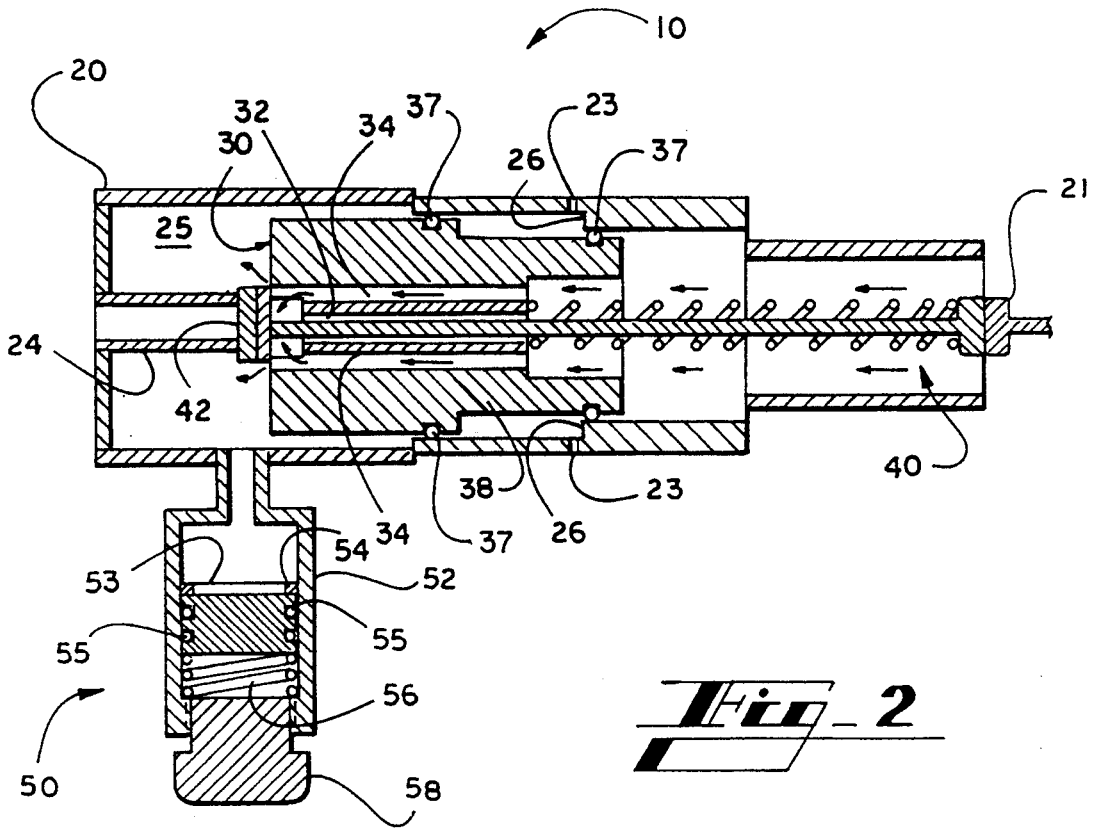
FIG. 2 is a sectional schematic illustration of the pulsator of FIG. 1 illustrating the positioning of the pulsator components prior to release of the plunger by the stopping mechanism.

The operation of the pulsator 10 will now be described with reference to FIGS. 2 through 5. FIGS. 2 through 5 are generally partial section views that illustrate somewhat actually and somewhat schematically the operation of the pulsator. FIG. 2 illustrates positioning of the components of the pulsator 10 prior to triggering of the device and as fluid 11 initially starts to flow from the rear of the main housing 20 through the fluid conduits 34 which extend through the primary piston 30. Initially, prior to the accumulation of fluid in the chamber 25 at the front of the main housing 20, the plunger 40 is held retracted in its rearmost position by the plunger spring 46. When the plunger 40 is at rest in a retracted position the head 42 of the piston abuts the top surface of the primary piston 30. The head 42 of the plunger generally covers the ends of the fluid conduits 34 which terminate at the top surface of the primary piston 30. Covering of the fluid conduit 34 ends is simplified because, as described above, the fluid conduits 34 are axially located in close proximity to the centralized bore 32. The abutment between the plunger head 42 and the top surface of the primary piston 30 is not sealed. Thus, fluid 11 is able to pass from the fluid conduits 34 around the edge of the plunger head 42 and into the chamber 25 at the front of the main housing 20. Fluid enters and begins to fill the chamber area 25 at the front of the main housing 25. Fluid 11 also flows from the main housing 20 into the accumulator housing 52 gradually pushing back the accumulator piston 54 biased upwardly by the accumulator spring 56. When the fluid 11 in the accumulator housing 52 becomes pressurized the fluid 11 in the chamber 25 also becomes pressurized and attempts to impel the primary piston 30 rearward. At the same time, the stop 21 prevents the plunger 40 from moving rearward.

Figure 3:
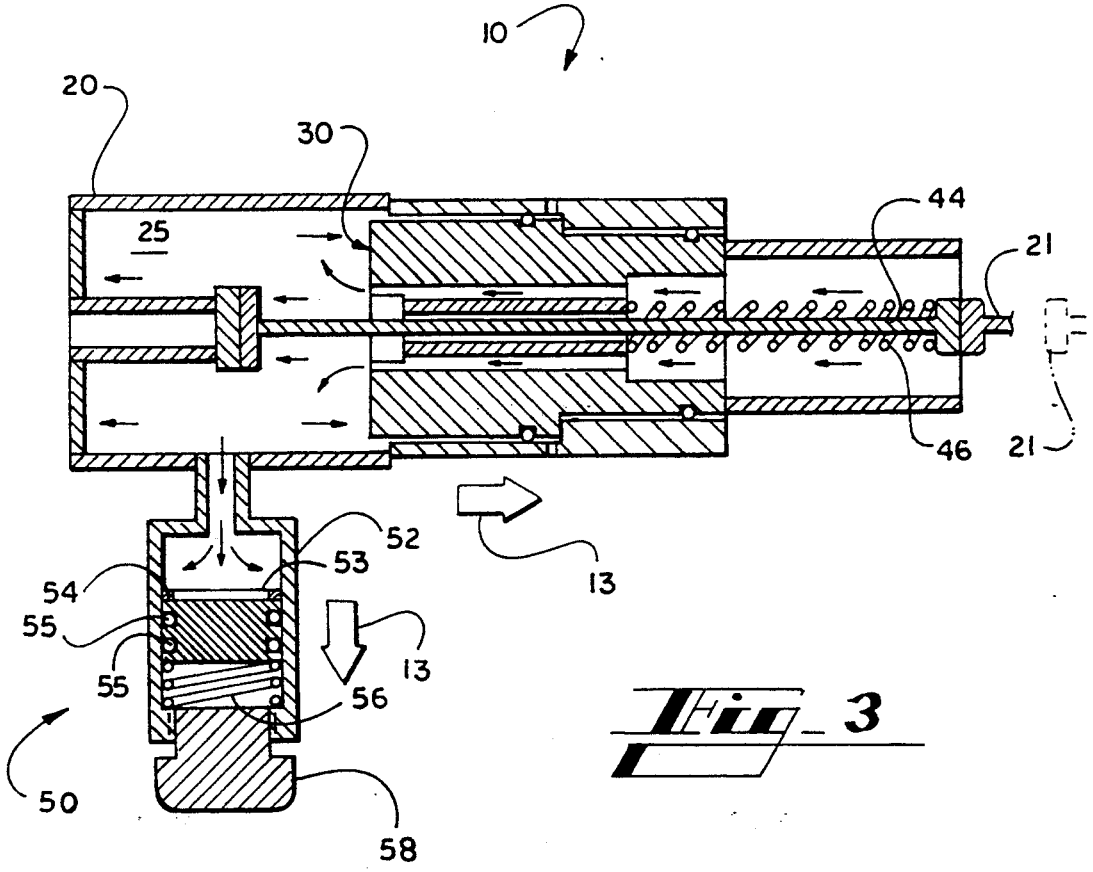
FIG. 3 is the same sectional schematic illustration as FIG. 2 but wherein water has begun to flow through the main housing and primary piston and the primary piston has moved to its rearwardmost position leaving the plunger in a forwardmost position.

Referring now to FIG. 3, after the chamber 25 becomes pressurized the force of the pressurized fluid impels the primary piston 30 rearward while the stop 21 still maintains the plunger 40 in a forward position with the plunger head 42, 43 covering the opening to the outlet conduit 24. The pressure force in the chamber 25 also helps keep the plunger head 42, 43 pressed over the opening to the outlet conduit 24. Thus, briefly, after the stop 21 has been removed, the plunger head 42, 43 remains positioned over the outlet conduit 24.

Figure 4:
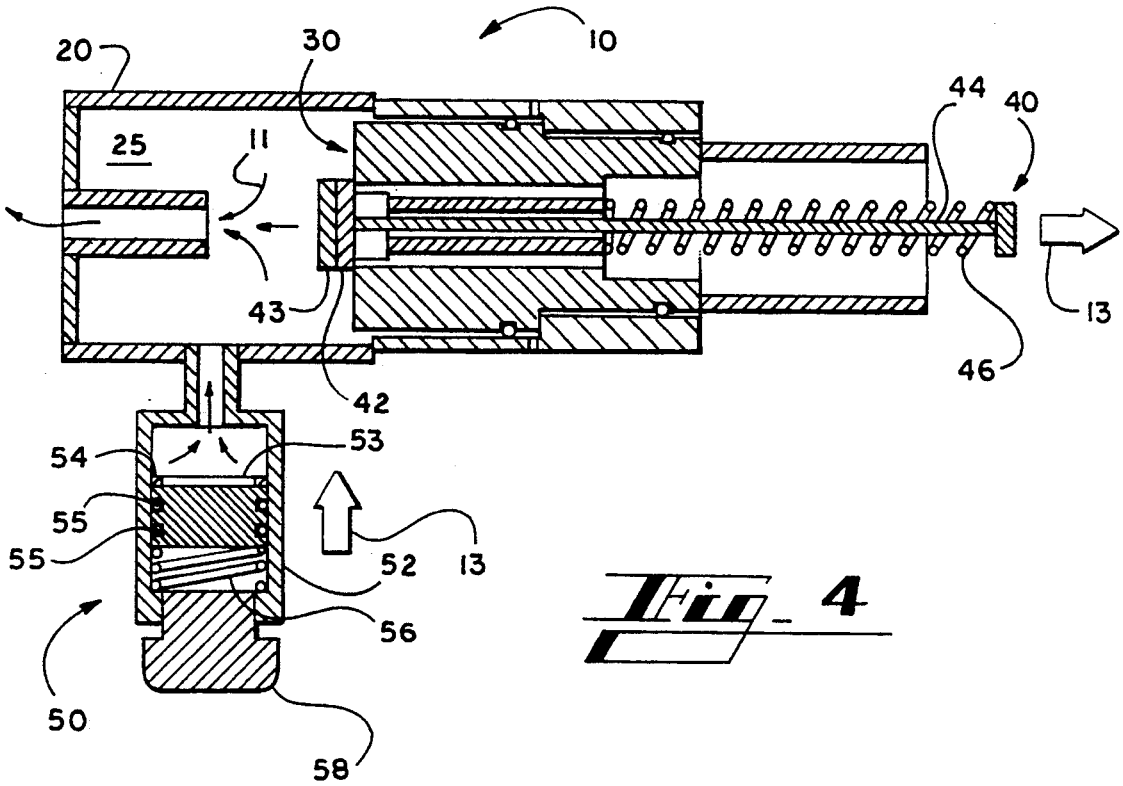
FIG. 4 is the same sectional schematic illustration as FIGS. 2 and 3 but wherein the plunger has been retracted to its rearwardmost position allowing a stream of fluid to burst through the outlet conduit.

Referring now to FIG. 4, when the primary piston 30 is impelled rearward by the force of pressurized fluid in the chamber 25 its rearward movement is limited by the flange 26 of the main housing 20. As the primary piston 30 moves rearward and the plunger 40 remains forwardly positioned, the plunger spring 46 is depressed, storing mechanical energy. When the force exerted by the energy stored in the plunger spring 46 exceeds the force exerted by pressurized fluid in the chamber 25 which maintains the plunger head 42 pressed against the outlet conduit 24 the plunger 40 is pulled rearwardly by the plunger spring 46. When the plunger head 42, 43 uncovers the opening into the outlet conduit 24 a burst of pressurized fluid passes through the outlet conduit 24.

Figure 5:
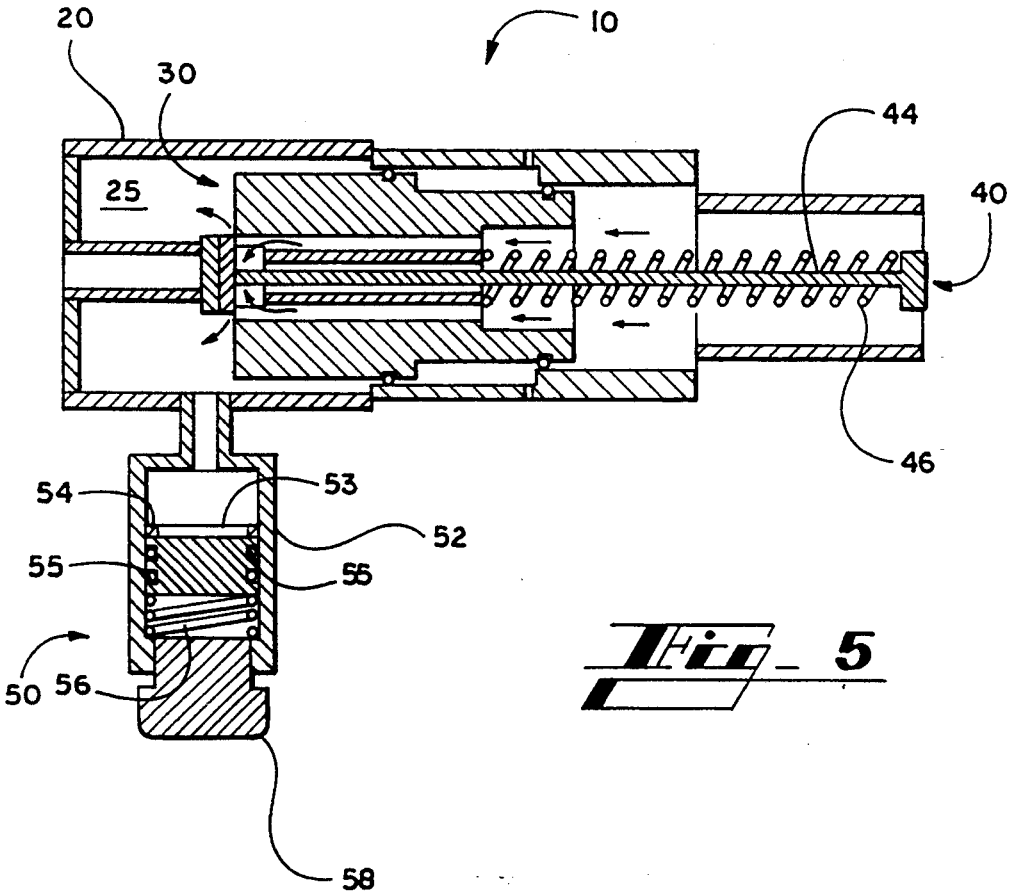
FIG. 5 is the same sectional schematic illustration as FIGS. 2, 3 and 4 but wherein the primary piston has returned to its forwardmost position.

Referring now to FIG. 5, when pressurized fluid exits the chamber 25 a pressure drop occurs there. Fluid pressure from the fluid source supplying the pulsator 10 pushes upon the rear end of the primary piston 30 impelling the primary piston 30 forward. Fluid again enters the chamber 25 from around the edge of the plunger head 42 as described previously. The combination of pressure drop in the chamber 25, suction created by departing pressurized fluid 11, fluid pressure upon the rear of the primary piston 30 and fluid flow from around the plunger head 42 causes the compressible surface 43 of the plunger head 42 to become pressed over the opening of the outlet conduit 24 again. After the opening to the outlet conduit 24 is sealed by the plunger head 42, 43 the chamber 25 and accumulator housing begin to fill and the pressurizing process starts again with the primary piston 30 being moved rearward by the fluid pressure force within the chamber 25.

The cycle of the pulsator 10 which produces an intermittent stream of fluid is rearward movement of the primary piston 30 (while the plunger 40 remains forward with its head 42, 43 covering the opening to the outlet conduit 24) followed by rearward movement of the plunger 40 to a retracted position (opening the outlet conduit for a burst of pressurized fluid) followed by forward movement of the primary piston 30 (along with the plunger 40, closing the outlet conduit). This cycle occurs very rapidly so as to create an oscillatory effect by the primary piston 30, plunger 40 and accumulator piston 54. The apertures 23 in the main housing 20 provide air intake and ventilating means which allow the primary piston 30 to move back and forth easily. To prevent oscillation from occurring so rapidly that the effectiveness of intermittency is diminished, the frequency of intermittency is retarded by the accumulator 50. The accumulator 50 causes re-pressurization of the chamber 25 after expulsion of pressurized fluid to occur more slowly. This is because pressure does not build up in the chamber 25 until pressure in the accumulator housing 52 begins increasing. As long as the fluid entering the accumulator housing 52 is able to move the accumulator piston 54 downward,, the fillable volume of the accumulator 52 continues to increase, thereby delaying pressurization of the chamber 25. Delay in pressurization causes the period during which no fluid exits the outlet conduit 24 to be greater than without the use of the accumulator 50. Thus, although the pulsator 10 achieves intermittency with the accumulator 50, the frequency of intermittency is modified and controlled by the use of the accumulator 50 component. In the accumulator 50 illustrated, the frequency is made adjustable by rotation of the adjusting knob 58. As previously mentioned, rotation of the adjusting knob 58 (clockwise or counterclockwise) adjusts the pre-compression of the accumulator spring 56. When the pre-compression of the accumulator spring 56 is increased, the maximum fillable volume of the accumulator 50 is decreased because the maximum downward position of the accumulator piston 54 is decreased. When the pre-compression of the accumulator spring 56 is decreased, the maximum fillable volume of the accumulator 50 is increased because the maximum downward position of the accumulator piston 54 is increased. When the maximum fillable volume of the accumulator 50 is decreased, a lesser amount of fluid must be accumulated in order for the device 10 to attain sufficient pressure to impel the primary piston 30 rearward and begin the process that results in a burst of pressurized fluid being released through the outlet conduit 24. Since a lesser amount of fluid must be accumulated, the time for accumulation is reduced and the time between bursts is reduced, thus resulting in an increased frequency of intermittency. When the maximum fillable volume of the accumulator 50 is increased, a greater amount of fluid must be accumulated in order for the device 10 to attain sufficient pressure to impel the primary piston 30 rearward and begin the process that results in a burst of pressurized fluid being released through the outlet conduit 24. Since a greater amount of fluid must be accumulated, the time for accumulation is increased and the time between bursts is increased, thus resulting in an reduced frequency of intermittency.

Figure 6:
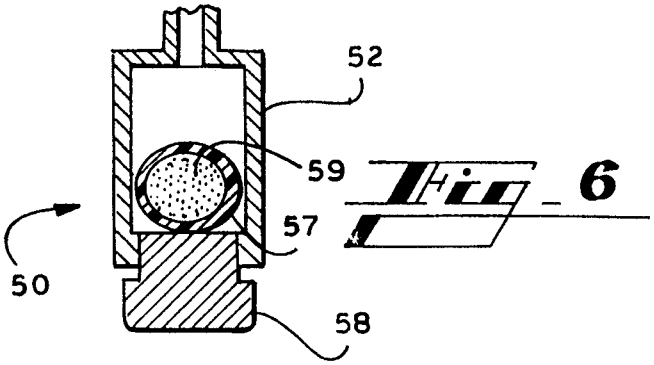
FIG. 6 is a cross-sectional representation on the accumulator of the pulsator of FIG. 1 with a compressible bladder as an alternate means of biasing.

As should be apparent from the foregoing specification, the invention is susceptible of being modified with various alterations and modifications which may differ from those which have been described in the preceding specification and description. For example, referring to FIG. 6, the accumulator 50 may utilize a bladder 57 filled with a compressible fluid 59 such as air as an alternate biasing means for gradually increasing the fillable volume of the accumulator housing 52 to an unyielding point. The fillable volume will increase until the bladder 57 can no longer be compressed by fluid 11 entering the accumulator housing 52 from the chamber 25 of the main housing 20. As previously described, when pressurized fluid 11 is expelled from the chamber 25 of the main housing 20, the biasing means of the accumulator (bladder 57) returns the accumulator piston 54 to a position wherein a least fillable volume is created in the accumulator housing 52. Accordingly, the following claims are intended to cover all alterations and modifications which do not depart from the spirit and scope of the invention.

What is claimed is:

1. A fluid pulsator comprising:

a main housing generally forming a sleeve, a chamber, and an outlet port at an anterior end thereof and having means for receiving fluid flow proximate a posterior end thereof;

an outlet conduit extending inwardly into said main housing from said outlet port terminating in a first end;

a primary piston reciprocally translatable within said main housing intermediate said anterior end of said main housing and said posterior end of said main housing and defining at least one fluid conduit therethrough;

a plunger reciprocally translatable through a bore in said primary piston and having a plunger head;

means biasing said plunger in a rearwardmost position with respect to said primary piston wherein said plunger head abuts a front surface of said primary piston and generally covers an end of said at least one fluid conduit terminating at said front surface of said primary piston when in said rearwardmost position;

means for selectively maintaining said plunger in a forwardmost position wherein said plunger head covers said first end of said outlet conduit;

means for limiting rearward reciprocal movement of said primary piston to a rearwardmost position wherein when said plunger head abuts said front surface of said primary pistons in said rearwardmost position of said piston and said plunger said fluid is able to freely flow through said first end of said outlet conduit; and means for delaying fluid pressurization of said chamber defined at said anterior end of said main housing.

2. The pulsator of claim 1, said means for delaying fluid pressurization of said chamber defined at said anterior end of said main housing comprising an accumulator housing attached to said main housing forming an accumulator chamber adapted for receiving fluid from said chamber of said main housing; and means for reciprocally varying a fillable volume of said accumulator chamber between a first position of minimum fillable volume and a second position of maximum fillable volume and biased to said first position of minimum fillable volume.

3. The fluid pulsator of claim 2, further comprising means for selectively increasing or decreasing said maximum fillable volume.

4. The fluid pulsator of claim 2, said means for reciprocally varying a fillable volume of said accumulator chamber between a first position of minimum fillable volume and a second position of maximum fillable volume and biased to said first position of minimum fillable volume comprising accumulator piston means reciprocally translatable within said accumulator housing, means affixed within said accumulator housing preventing translational movement of said accumulator piston in a direction which reduces the fillable volume of said accumulator chamber beyond a predetermined position, and accumulator spring means.

5. The fluid pulsator of claim 1, a surface of said plunger head which Covers said first end of said outlet conduit comprising compressible material.

6. A fluid pulsator comprising:

a main housing generally forming a sleeve, a chamber, and an outlet port at an anterior end thereof and having means for receiving fluid flow proximate a posterior end thereof;

an outlet conduit extending inwardly into said main housing from said outlet port terminating in a first end;

a primary piston reciprocally translatable within said main housing intermediate said anterior end of said main housing and said posterior end of said main housing and defining a bore and a plurality of fluid conduits disposed proximate said bore axially therethrough;

a plunger reciprocally translatable through said bore in said primary piston and having a plunger head;

means biasing said plunger in a rearwardmost position with respect to said primary piston wherein said plunger head abuts a front surface of said primary piston and generally covers an end of said at least one fluid conduit terminating at said front surface of said primary piston when in said rearwardmost position;

means for selectively maintaining said plunger in a forwardmost position wherein said plunger head covers said first end of said outlet conduit;

means for limiting rearward reciprocal movement of said primary piston to a rearwardmost position wherein when said plunger head abuts said front surface of said primary piston in said rearwardmost position of said piston and said plunger, said fluid is able to freely flow through said first end of said outlet conduit; and accumulator means having an accumulator housing attached to said main housing forming an accumulator chamber adapted for receiving fluid from said chamber of said main housing; and means for reciprocally varying a fillable volume of said accumulator chamber between a first position of minimum fillable volume and a second position of maximum fillable volume and biased to said first position of minimum fillable volume.

7. The fluid pulsator of claim 6, further comprising means for selectively increasing or decreasing said maximum fillable volume.

8. The fluid pulsator of claim 6, said means for reciprocally varying a fillable volume of said accumulator chamber between a first position of minimum fillable volume and a second position of maximum fillable volume and biased to said first position of minimum fillable volume comprising accumulator piston means reciprocally translatable within said accumulator housing, means affixed within said accumulator housing preventing translational movement of said accumulator piston in a direction which reduces the fillable volume of said accumulator chamber beyond a predetermined position, and accumulator spring means.

9. The fluid pulsator of claim 6, a surface of said plunger head which covers said first end of said outlet conduit comprising compressible material.

10. A fluid pulsator comprising:

a main housing generally forming a sleeve, a chamber, and an outlet port at an anterior end thereof and having means for receiving fluid flow proximate a posterior end thereof;

an outlet conduit extending inwardly into said main housing from said outlet port terminating in a first end;

a primary piston reciprocally translatable within said main housing intermediate said anterior end of said main housing and said posterior end of said main housing and defining a bore and a plurality of fluid conduits disposed proximate said bore axially therethrough, defining a plurality of fluid conduits therethrough axially disposed proximate said bore;

a plunger reciprocally translatable through said bore in said primary piston and having a plunger head;

means biasing said plunger in a rearwardmost position with respect to said primary piston wherein said plunger head abuts a front surface of said primary piston and generally covers an end of said at least one fluid conduit terminating at said front surface of said primary piston when in said rearwardmost position;

means for selectively maintaining said plunger in a forwardmost position wherein said plunger head covers said first end of said outlet conduit;

means for limiting rearward reciprocal movement of said primary piston to a rearwardmost position wherein when said plunger head abuts said front surface of said primary piston in said rearwardmost position of said piston and said plunger, said fluid is able to freely flow through said first end of said outlet conduit; and accumulator means having an accumulator housing attached to said main housing forming an accumulator chamber adapted for receiving fluid from said chamber of said main housing, having accumulator piston means reciprocally translatable within said accumulator housing, having accumulator spring means proximate a bottom end of said accumulator housing adapted for biasing said accumulator piston means, and having a threaded member engaged upon said bottom end adapted for selectively increasing and decreasing pre-compression of said accumulator spring means.

* * * * *